US010383421B2

(12) United States Patent
Fereyre

(10) Patent No.: US 10,383,421 B2
(45) Date of Patent: Aug. 20, 2019

(54) STEAM HAIRDRESSING APPLIANCE WITH STEAM CONTAINMENT MEANS

(71) Applicant: SEB S.A., Ecully (FR)

(72) Inventor: Régis Fereyre, Chavanay (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 14/709,939

(22) Filed: May 12, 2015

(65) Prior Publication Data

US 2015/0327650 A1 Nov. 19, 2015

(30) Foreign Application Priority Data

May 14, 2014 (FR) ..... 14 54271

(51) Int. Cl.

| | |
|---|---|
| ***A45D 19/16*** | (2006.01) |
| ***A45D 1/00*** | (2006.01) |
| ***A45D 1/04*** | (2006.01) |
| ***A45D 1/06*** | (2006.01) |
| ***A45D 2/00*** | (2006.01) |
| ***A45D 1/08*** | (2006.01) |
| ***A45D 1/28*** | (2006.01) |

(52) U.S. Cl.

CPC ..... *A45D 19/16* (2013.01); *A45D 1/00* (2013.01); *A45D 1/04* (2013.01); *A45D 1/06* (2013.01); *A45D 1/08* (2013.01); *A45D 1/28* (2013.01); *A45D 2/001* (2013.01); *A45D 2/002* (2013.01); *A45D 2001/008* (2013.01)

(58) Field of Classification Search

CPC ..... A45D 19/16; A45D 2001/008; A45D 1/06

USPC ..... 132/228, 227

See application file for complete search history.

(56) References Cited

U.S. PATENT DOCUMENTS

| | | | | |
|---|---|---|---|---|
| 2,880,299 | A | 3/1959 | Jones | |
| 8,757,175 | B1 * | 6/2014 | Leung | A45D 1/04 132/228 |
| 2004/0000319 | A1 * | 1/2004 | Carballada | A45D 1/04 132/224 |
| 2005/0061352 | A1 * | 3/2005 | Yao | A45D 1/04 132/225 |
| 2008/0283081 | A1 * | 11/2008 | Habibi | A45D 1/04 132/224 |

(Continued)

FOREIGN PATENT DOCUMENTS

| | | | |
|---|---|---|---|
| EP | 1396207 | A1 | 3/2004 |
| EP | 1516554 | A1 | 3/2005 |

(Continued)

*Primary Examiner* — Tatiana L Nobrega

(74) *Attorney, Agent, or Firm* — The Webb Law Firm

(57) ABSTRACT

Provided is a hairdressing appliance comprising a portable treatment unit equipped with two arms configured to form a clamp provided with two surfaces positioned opposite each other that enable the simultaneous clamping of a lock of hair. The portable treatment unit comprises steam spraying means that is configured to disperse the steam from the first of two surfaces towards the second of the two surfaces. The appliance comprises a means for containing the steam dispersed between the two surfaces that are pressed together. Thus provided is a hairdressing appliance whose performance is comparable to that of hairdressing appliances with high flows of steam, yet while using a reduced flow of steam.

13 Claims, 5 Drawing Sheets

(56) References Cited

U.S. PATENT DOCUMENTS

| | | | | |
|---|---|---|---|---|
| 2010/0101599 | A1* | 4/2010 | Choi | A45D 1/04 132/269 |
| 2012/0111356 | A1* | 5/2012 | Vacheron | A45D 1/04 132/228 |
| 2012/0272993 | A1* | 11/2012 | Fereyre | A45D 1/04 132/221 |
| 2015/0289622 | A1 | 10/2015 | Fereyre et al. | |

FOREIGN PATENT DOCUMENTS

| | | | | | |
|---|---|---|---|---|---|
| EP | 1515628 | B1 | | 6/2007 | |
| EP | 1515629 | B1 | | 12/2007 | |
| EP | 2789257 | A2 | * | 10/2014 | A45D 1/04 |
| FR | 2967017 | A1 | | 5/2012 | |
| JP | 2000157322 | A | | 6/2000 | |
| WO | WO 2014064660 | A1 | * | 5/2014 | A45D 1/04 |
| WO | WO2014064660 | A1 | | 5/2014 | |
| WO | WO 2015097625 | A2 | * | 7/2015 | A45D 1/04 |

* cited by examiner

STEAM HAIRDRESSING APPLIANCE WITH STEAM CONTAINMENT MEANS

CROSS-REFERENCE TO RELATED APPLICATIONS

This application claims priority to French Patent Application No. 1454271 filed May 14, 2014, the disclosure of which is hereby incorporated in its entirety by reference.

FIELD OF THE INVENTION

The invention relates to a steam hairdressing appliance comprising a portable steam treatment unit intended to steam treat hair for its shaping. In addition to steaming hair, the portable treatment unit of this hairdressing appliance is generally configured to heat hair for its shaping. Depending upon its configuration, such a hairdressing appliance can be used for straightening, curling, or crimping hair.

DESCRIPTION OF RELATED ART

Various hairdressing appliances that enable the treatment of hair for its straightening, curling, or crimping are known to the prior art. These hairdressing appliances comprise a portable treatment unit consisting, inter alia, of two arms, or jaws, each of which has a surface that may be flat or curved. The two arms are hinged together to form a clamp configured to clamp the hair between the two surfaces positioned opposite each other, when the two arms are brought together. These two arms also comprise a gripping zone enabling the opening and closing of the clamp and the manipulation thereof during the styling. At least one of these two surfaces has a heating device enabling the treatment of hair with heat while it is clamped. The straightening of a lock of hair is effected by clamping the lock of hair between the two surfaces and by moving the closed clamp along this lock of hair, from the root to the tip. The curling of a lock of hair is effected by clamping the lock of hair between the two surfaces and by winding, at least partially, this lock of hair around the surfaces, the heat making it possible to set the curl of hair.

For improving the hair styling, using steam treatment as a supplement to the heat treatment is known to the prior art, said steam being sprayed or dispersed on the hair. Various exemplary embodiments of such hairdressing appliances are described in documents JP2000157322A, EP1396207A1, EP1515628B1, EP1515629B1, EP1516554B1, and FR2967017A1. Depending on these various embodiments, in addition to the other known and aforementioned characteristics of a hairdressing appliance, the portable treatment unit comprises steam spraying means that are configured to spray steam from one of the two surfaces towards the second of the two surfaces. In documents EP1396207A1 and EP1516554B1, the portable treatment unit comprises steam suction means arranged on said second surface to evacuate the steam sprayed from said first surface after it has passed through the lock of hair. In documents EP1515628B1 and EP1515629B1, in an alternative embodiment, the steam spraying means are configured to spray steam from the two surfaces positioned opposite one another during the clamping. In document FR2967017A1, a patent application filed by the applicant, the optimized design of the vaporization means enables a flow of steam in the order of 3 to 4 g/min, which is greater than other hairdressing appliance designs that provide a flow of steam of less than 2 g/min, which makes it possible to provide uniform steam over the entire width of the clamped lock of hair during the steam treatment and enables the rapid treatment of said lock of hair with steam while the portable treatment unit is moved along this lock of hair.

The object of this invention is to implement a hairdressing appliance whose performance is comparable to that of the hairdressing appliance described in document FR2967017A1 while reducing its bulkiness, for example by reducing the width of the hairdressing appliance and/or for example, its height.

The object of this invention is to implement a hairdressing appliance whose performance is comparable to that of the hairdressing appliance described in document FR2967017A1, yet while using a reduced flow of steam.

The object of this invention is to implement a hairdressing appliance whose performance is comparable to that of the hairdressing appliance described in document FR2967017A1, while simplifying its design.

The object of this invention is to implement a hairdressing appliance whose performance is comparable to that of the hairdressing appliance described in document FR2967017A1, while reducing its manufacturing cost.

The object of this invention is to implement a hairdressing appliance whose performance is comparable to that of the hairdressing appliance described in document FR2967017A1, while reducing the volume of liquid used for vaporization.

SUMMARY OF THE INVENTION

To this end, the invention relates to a hairdressing appliance comprising a portable treatment unit equipped with two arms configured to form a clamp provided with two surfaces positioned opposite each other that enable the simultaneous clamping of a lock of hair. The portable treatment unit comprises steam spraying means that are configured to spray steam from one of the two surfaces towards the second of the two surfaces. Notably, the hairdressing appliance comprises a means of containing the steam dispersed between the two surfaces that are pressed together. These containment means make it possible to ensure a quantity of steam remains in contact with the lock of hair with a uniform distribution, within a containment space positioned between the two surfaces that clamp said lock, so as to enhance the steam treatment. This steam remains in the containment space for a period of time before escaping under the action of the flow of steam. The steam containment advantageously enables a reduction in the flow of steam from the vaporization means of the portable treatment unit. The steam is transported and circulated through dispersion means or even through spraying means, with circulation being possible with or without overpressure.

According to the hairdressing appliance of the invention, the steam containment means comprise a channel arranged in the second of the two surfaces, opposite the dispersion means. Thus the steam passes through the lock of hair and remains contained in said channel.

According to this implementation of the hairdressing appliance of the invention, the channel exits onto at least one of the two longitudinal edges of the second surface so as to allow the escape of this steam under the action of the flow of steam exiting the dispersion means, after this steam has remained contained in said channel. The steam in the containment space is thus renewed. This makes it possible to maintain steam pressure in the containment space, with this pressure being essentially constant.

According to this implementation of the hairdressing appliance of the invention, the channel has a width ranging between 2 and 6 mm, preferably 2.5 mm, and a depth ranging between 0.5 and 2 mm, preferably 1 mm. These dimensions optimize the containment space so as to maintain a sufficient volume of renewed steam in contact over the width of a lock of hair in order to treat it. Furthermore, the channel has a length ranging between 20 and 220 mm, preferably 90 mm, so as to optimize the volume of the containment space for a reduced flow of steam ranging between 0.5 and 2 g/min, preferably between 0.9 and 1.2 g/min.

According to the hairdressing appliance of the invention, the first surface comprises a groove with a bottom, the steam dispersion means being arranged to disperse steam from said bottom, and the steam containment means comprising the groove, in addition to or in place of the aforementioned channel arranged in the second of the two surfaces.

When the hairdressing appliance of the invention simultaneously comprises a channel and a groove as mentioned above, said channel is arranged opposite said groove. Furthermore, the channel and the groove preferably have a volume that is essentially identical.

In an alternative embodiment of the hairdressing appliance of the invention, and equipped with a channel as mentioned above, the first surface comprises two adjacent grooves each with a bottom, the dispersion means being arranged to disperse steam from at least one of said two bottoms. Furthermore, the channel is arranged opposite the two grooves.

According to the hairdressing appliance of the invention, at least one groove exits onto at least one of the two longitudinal edges of the first surface, which allows the escape of the steam after it has been dispersed and has remained in the containment space.

In an embodiment of the hairdressing appliance of the invention, the steam dispersion means comprise a plurality of dispersion openings arranged over the length of the bottom of the at least one groove. In an alternative embodiment, these steam dispersion means comprise a dispersion vent arranged over the length of the bottom of the at least one groove.

In an embodiment of the hairdressing appliance of the invention, a grid is arranged above the at least one groove on the first surface. This helps better distribute the steam over the lock of hair.

In another embodiment of the hairdressing appliance of the invention, the latter is a equipped with a single groove that has a curved shape. Furthermore, the channel comprises a rounded grid with a shape that is complementary to said curved groove. This helps better distribute the steam over the lock of hair, while placing it under tension as the portable treatment unit that is clamping said lock is being moved.

In another embodiment of the hairdressing appliance of the invention, the latter comprises a groove and a channel that have a circular shape so as to form a cylinder when the clamp is in a closed position. Furthermore, the hairdressing appliance comprises a perforated roller rotatably mounted within said cylinder. This makes it possible to distribute the steam in the containment space constituted by said cylinder, with the rotation of the roller preventing the pulling of the lock of hair while the portable treatment unit is moving along this lock.

According to the hairdressing appliance of the invention, the steam containment means are offset on the surfaces. It should be understood that the containment means are not in the middle of the surfaces, rather upstream or downstream on the surfaces. More precisely, the containment means may take the form of a containment system that is offset on the treatment surface, for example a single assembly formed at least by the channel that is offset on the treatment surface or straightening plate in relation to its medial plane crossing it orthogonally.

According to the hairdressing appliance of the invention, the two surfaces are each equipped with a heating plate, said heating plates being positioned opposite one another and simultaneously enabling the clamping of a lock of hair. This enables a heat treatment of the lock of hair, simultaneously with the steam treatment.

According to this embodiment of the hairdressing appliance with two heating plates, the steam containment means are preferably arranged between said two heating plates. This provides the benefit of reheating the steam that is present in the containment space.

According to this preferential embodiment of the hairdressing appliance of the invention, the steam containment means are offset on the portions positioned upstream on the heating plates, which enables the steam treatment of the lock of hair prior to the heat treatment, while the portable treatment unit is being moved along said lock. Preferably, the midpoint of the containment means is located at a distance d1 from the upstream edge of the heating plates, with the ratio of the distance d1 to the width w1 of the heating plates ranging between 0.1 and 0.4.

According to the hairdressing appliance of the invention, a comb is arranged upstream from one of the surfaces. This enables the untangling and aeration of the lock of hair prior to its steam treatment, thus enhancing the passage of the steam among the hair.

According to the hairdressing appliance of the invention, the latter comprises a vapor barrier that is configured to block the steam escaping from the containment means in the direction of the proximal portion of the clamp, said proximal portion being configured to manipulate the portable treatment unit. Thus the hand that manipulates the portable treatment unit is protected from burns caused by steam.

According to the hairdressing appliance of the invention, the steam dispersion means are configured to have a flow of steam ranging between 0.5 g/min and 2 g/min, preferably between 0.9 g/min and 1.2 g/min. This enables the implementation of traditional or novel vaporization means on the portable treatment unit, which has a limited bulkiness and a simplified design, in comparison to those described in document FR2967017A1.

BRIEF DESCRIPTION OF THE DRAWINGS

The following description of the different alternative embodiments reveals the features and advantages of the hairdressing appliance of the invention. This description is based on the following figures, in which.

DETAILED DESCRIPTION OF THE INVENTION

In the following description, the same references are used to designate identical or similar features according to the different design alternatives of the hairdressing appliance of the invention, which are described based on FIGS. 1 to 12.

Figure 1:
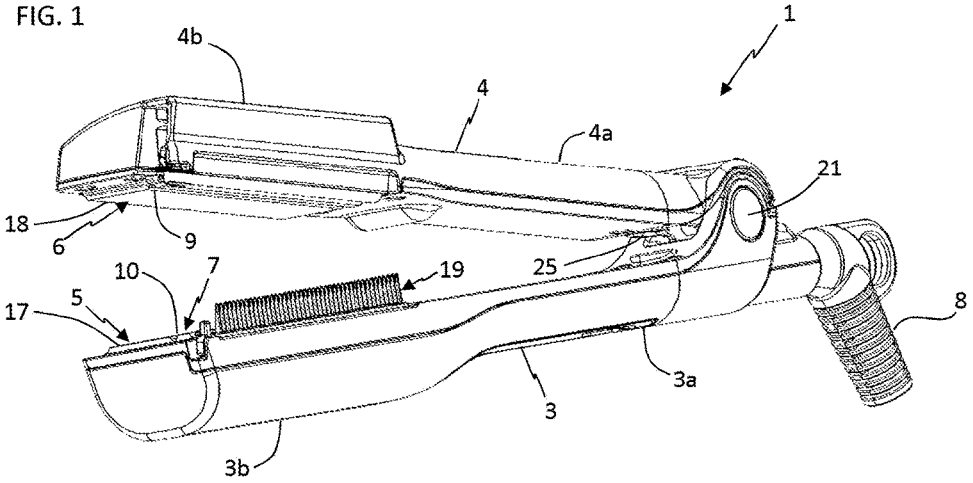
FIG. 1 illustrates a hairdressing appliance of the invention, of the steam straightener type.

In FIG. 1, the hairdressing appliance 1 of the invention is a hair straightener.

The latter comprises a portable treatment unit 2. This portable treatment unit 2 is powered electrically by means of an electric connecting cable 8. The portable treatment unit 2 comprises two arms 3, 4—also known as jaws—hinged to one another by means of a pivot linkage 21, thus constituting a clamp.

The two arms 3, 4 each comprise a proximal portion 3*a*, 4*a*. These two proximal portions 3*a*, 4*a* can be grasped simultaneously with one hand, thus making it possible to manipulate the portable treatment unit 2 and close the clamp when the two proximal portions 3*a*, 4*a* are clasped.

The two arms 3, 4 each comprise, on their inside face and in their distal portion 3*b*, 4*b*, a surface 5, 6 enabling the clamping of the lock of hair simultaneously. According to the embodiment of FIG. 1, the heating surfaces 5, 6 are flat and in the shape of two heating plates 17, 18. When the clamp is closed, the heating surfaces 17, 18 positioned opposite one another come into contact with one another, thus enabling said clamping.

In one embodiment, the portable treatment unit 2 of the hairdressing appliance 1 of the invention can assume technical features similar to those described in French Patent Application FR2967017A1 filed by the Applicant in terms of the implementation of the heating means (not illustrated) of the heating plates 17, 18.

Thus the heating means for the heating plates 17, 18 each comprise a heating device (not illustrated) consisting of a positive temperature coefficient (PTC) thermistor, and a device (not illustrated) for measuring the temperature of the heating device composed of a negative temperature coefficient (NTC) thermistor. These heating and measurement devices will be positioned in the housing areas 22, 23 on each arm 3, 4, for each of the heating plates 17, 18. The features of such heating means for the heating plates 17, 18 are known to those skilled in the art, and will not be discussed in greater detail. Alternative embodiments, whether novel or known to those skilled in the art, are also conceivable for these heating means for the heating plates 17, 18, without exceeding the scope of the invention. Furthermore, alternative shapes are conceivable for the surfaces 5, 6. Curved surfaces, particularly as in hairdressing appliances used for curling hair, or even undulated surfaces, as in hairdressing appliances used to crimp hair, inter alia, can be implemented. Alternative embodiments of the portable treatment unit 2 with only one of the two surfaces 5 or 6 being a heating surface, and with the other surface merely helping to clamp the lock of hair for styling the same are furthermore conceivable.

Figure 2:
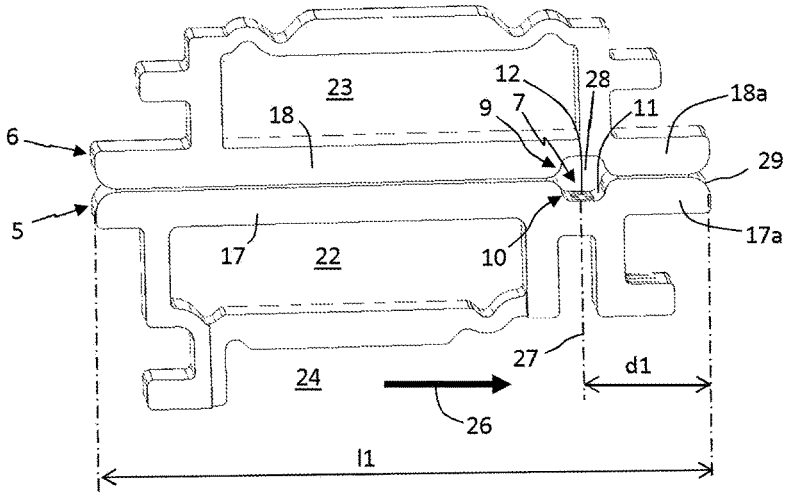
FIGS. 2 and 3 show two heating plates as arranged on the two arms of the portable treatment unit in the clamping position and in the open position of the clamp, respectively.
Figure 3:
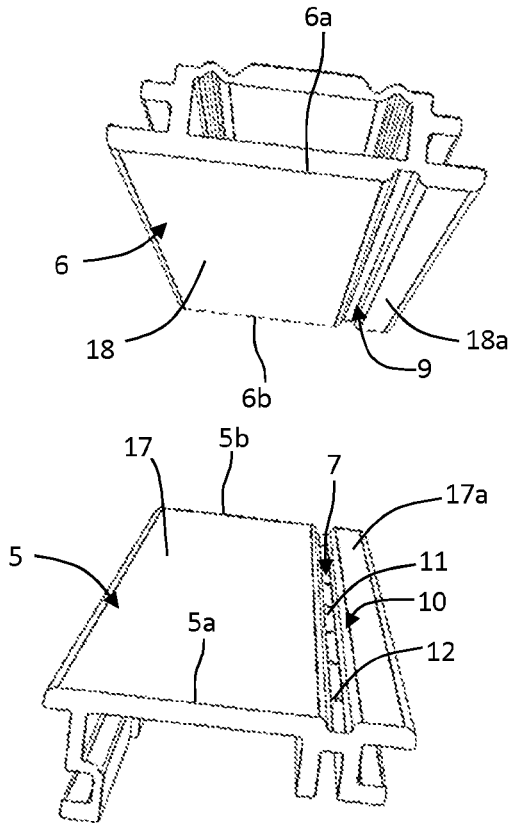

The portable treatment unit 2 of the hairdressing appliance 1 likewise comprises means for spraying or dispersing steam 7 from the first surface 5 towards the second surface 6. As illustrated in FIGS. 1 to 3, the first arm 3 comprises a groove 10 with a bottom 11 in which are arranged openings 12 that enable the spraying or dispersion of steam in the direction of the second arm 4, when the clamp is closed. In its distal portion 3*b*, the first arm 3 also comprises a vaporization chamber (not illustrated) for generating steam and spraying or dispersing this steam through the openings 12. In one embodiment, the portable treatment unit 2 of the hairdressing appliance 1 of the invention can assume technical features similar to those described in French Patent Application FR 2 967 017 A1 filed by the Applicant in terms of the implementation of the vaporization chamber. Thus, this vaporization chamber comprises, inter alia, a heating device (not illustrated) consisting of a positive temperature coefficient (PTC) thermistor, and a device (not illustrated) for measuring the temperature of the heating device composed of a negative temperature coefficient (NTC) thermistor. These heating and measurement devices are arranged in a second housing area 24 illustrated in FIG. 2, under the first housing area 22. Alternative embodiments, whether novel or known to those skilled in the art, are also conceivable for this vaporization chamber, without exceeding the scope of the invention. Preferably, eight openings 12 of a diameter of 1.2 mm are arranged in the bottom 11 of the groove 10. Additionally, the steam spraying or dispersion means are configured to spray or disperse the steam with a flow ranging between 0.5 g/min and 2 g/min, preferably between 0.9 g/min and 1.2 g/min. The person skilled in the art is able to dimension said steam spraying or dispersing means to obtain such a flow. However, a flow between 0.5 g/min and 5 g/min, for example essentially equal to 4 g/min, is possible for a hairdressing appliance that is less bulky than that described in document FR2967017A1, which is capable of producing the same flow.

Other features, also known to the person skilled in the art, are likewise implemented on the hairdressing appliance 1 of the invention. The portable treatment unit 2 comprises, inter alia, an electronic card (not illustrated) that is configured to control the activation of the heating plates 17, 18 and the vaporization chamber. This electronic card is arranged inside one of the two arms 3, 4, for example in the proximal portion 3*a* of the first arm 3. The portable treatment unit 2 comprises a magnetic reed switch (FR: ILS) sensor 25, illustrated in FIG. 1, which enables the detection of the closed position of the clamp in which the two surfaces 5, 6 are brought together and clamp a lock of hair. In an alternative embodiment, the reed switch could be replaced with a magnetoresistive sensor (MRS).

As illustrated in FIGS. 1 to 3, the groove 10 is implemented in the upstream portion 17*a* of the first heating plate 17 (or first surface 5 that is not necessarily a heating surface), relative to the direction of the portable treatment unit's 2 movement from the roots to the tips of the hair, as represented by the arrow 26 in FIG. 2. This makes possible to steam treat the lock of hair prior to the heat treatment (respectively, or by clamping that is not necessarily heated).

The groove 10 preferably empties at its two ends on the longitudinal edges 5*a*, 5*b* of the first surface 5. However, it is possible to conceive an alternative embodiment in which the groove 10 exits solely on one of the longitudinal edges 5*a*, 5*b*. As illustrated in FIG. 2, the midpoint 27 of the groove 10 is positioned at a distance d1 from the upstream lateral edge 29 of the first heating plate 17. The ratio of this distance d1 to the width w1 of this heating plate 17 preferably ranges between 0.1 and 0.4. For example, the width of the plate is equal to 28.9 mm and the distance d1 is equal to 6.25 mm, corresponding to a ratio of 0.22.

As illustrated in FIGS. 1 to 3, a channel 9 is arranged in the upstream portion 18*a* of the second heating plate 18, opposite the groove 10. According to this embodiment, the channel 9 and the groove 10 have a shape and volume that are essentially identical. The channel or the channel and groove assembly make it possible to form the containment means for the dispersed steam. As with groove 10, the channel 9 empties at its two ends on the longitudinal edges 6*a*, 6*b* of the second surface 6. The channel 9 and the groove 10 are dimensioned to simultaneously constitute a containment space 28 for the steam that is circulating from the openings 12. This containment space 28 makes it possible to contain the steam around the lock of hair clamped between the two surfaces 5, 6, before letting this steam escape via the ends of the channel 9 and the groove 10 due to the renewal of the steam circulating through the openings 12. The steam's containment enhances the steam treatment of the lock of hair while utilizing a reduced flow of steam, preferably ranging between 0.9 g/min and 1.2 g/min, while ensuring a more or less rapid movement of the portable treatment unit 2 along the lock of hair. Furthermore, the implementation of the containment space 28 between the two heating plates 17, 18 advantageously enables the reheating of the steam contained in said space. To implement this containment space 28, a groove 10 width ranging between 2 and 6 mm, preferably 2.5 mm, and a groove 10 depth ranging between 0.5 and 2 mm, preferably 1 mm, are chosen. In addition, the volume of the groove 10 preferably ranges between 200 $mm^3$ and 275 $mm^3$, and preferably 225 $mm^3$. The length of the groove 10 preferably ranges between 20 mm and 220 mm, and preferably 90 mm. The dimensions and the volume of the channel 9 are preferably similar, which makes it possible to obtain a volume for the containment space 28 ranging between 400 $mm^3$ and 550 $mm^3$, and preferably 450 $mm^3$.

Figure 4:
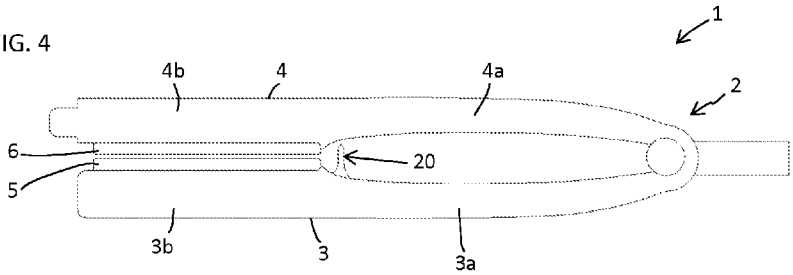
FIG. 4 illustrates a hairdressing appliance of the invention, revealing the presence of a vapor barrier.

As illustrated in FIG. 4, the portable treatment unit 2 comprises a vapor barrier 20 that is arranged on the first arm 3 at the proximal longitudinal edge 5*a* of the first surface 5. This vapor barrier 20 prevents the steam that is escaping from the containment space 28 from entering into the gripping area of the portable treatment unit 2 constituted by the proximal portions 3*a*, 4*a* of the two arms 3, 4.

Figure 5:
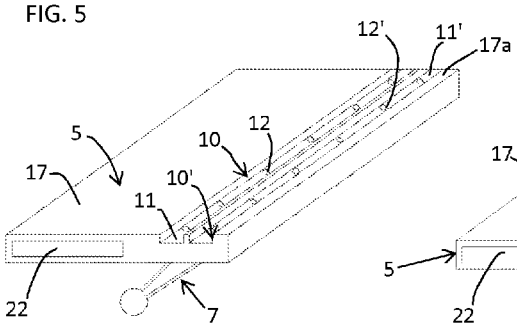
FIG. 5 illustrates a heating plate equipped with two adjacent grooves holding the steam dispersion means.

FIG. 5 illustrates a variation of the implementation of the steam spraying or dispersion means 7 on the first surface 5. These steam spraying or dispersion means 7 comprise two adjacent grooves 10, 10' similar in design to that illustrated in FIGS. 1 to 3, arranged on the upstream portion 17*a* of the first heating plate 17. Each groove, 10, 10' comprises openings 12, 12' arranged in the bottom 11, 11' of said groove 10, 10' through which the steam is sprayed, dispersed, or transported. According to this implementation, the channel 9 arranged on the second heating plate 18 has a width corresponding to the total width of the two grooves 10, 10'. The flow of steam likewise ranges between 0.5 g/min and 2 g/min, preferably between 0.9 g/min and 1.2 g/min. The volume of the containment space is in this case constituted by the volumes of the channel 9 and the grooves 10, 10'. This volume is within a range of values double to that of the volume of the containment space 28 of the embodiment in FIGS. 1 to 3. In effect this doubles the steam canal or channel of the previous embodiments such that the steam follows a dual channel and the lock of hair is treated twice by the steam. The channels may be in fluid circulation at one of the ends of the surface or surfaces. In this steam circulation configuration with parallel channels formed by a channel in the complete shape of a U, an alternative is that the steam outlet openings are only present on one of the channels (not illustrated).

Figure 6:
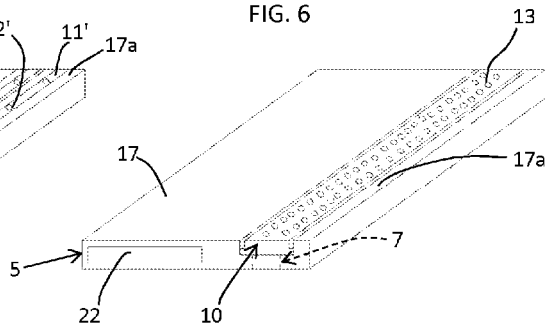
FIG. 6 illustrates a heating plate equipped with a groove equipped with a perforated grid.

In FIG. 6, the steam spraying or dispersion means 7 are similar to those in FIGS. 1 to 3. In addition, a grid 13 is arranged above the groove 10, which enhances the uniform distribution of the steam that is produced and transferred in the containment space 28 comparable to that illustrated in FIGS. 1 to 3. Such a grid 13 can be implemented on each groove 10, 10' of the embodiment illustrated in FIG. 5.

Figure 7:
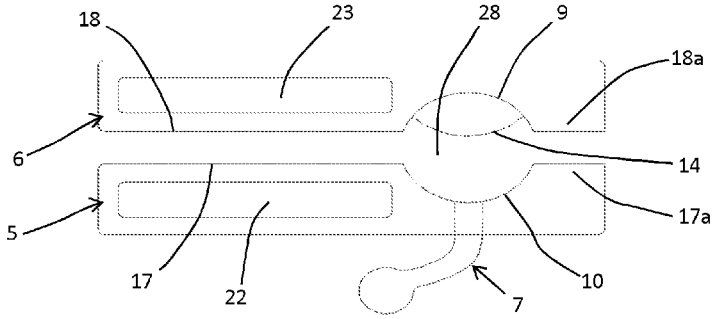
FIG. 7 illustrates two heating plates in the clamping position and reveals a curved shape of the groove and a rounded perforated grid on the channel.

In the embodiment of FIG. 7, the groove 10 has a curved shape.

The channel 9 comprises a rounded grid 14 with a shape that is complementary to said curved groove 10. This rounded grill makes it possible to distribute the steam uniformly in the containment space 28 and shoot it over the lock of hair while the portable treatment unit 2 is being moved. The volume of the containment space 28 will be within a range of values similar to that of the embodiment in FIGS. 1 to 3.

Figure 8:
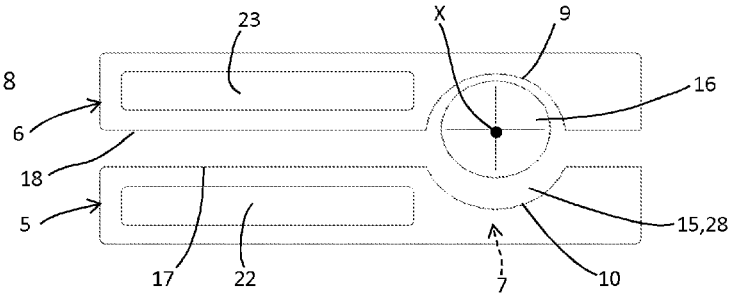
FIG. 8 illustrates two heating plates in the clamping position and reveals a cylindrical form constituted by the groove and the channel, with the presence of a perforated roller in the cylinder.

In FIG. 8, the groove 10 and the channel 9 are circular in shape and define a cylinder 15 when the clamp is closed, said cylinder 15 defining the containment space 28. In addition, a perforated roller 16 is arranged in rotation along an axis X inside the cylinder 15. This perforated roller 16 may be motorized. The volume of the cylinder 15 will be within a range of values similar to that of the volume of the containment space 28 for the embodiment in FIGS. 1 to 3.

FIGS. 9, 10, 11 and 12 each illustrate alternative embodiments of the containment means of FIG. 2, but may be implemented in all modes described, either alone or in combination. The common point of these modes is one or two particular referenced part(s) 30, 30*a* that are inserted individually or each into one or two converted spaces (still called gutters) in the heating plate(s). Such a part introduced into the plate defines at least partially the outline of the containment means. This part or parts makes it possible to introduce additional functionalities to the contained steam treatment.

Figure 9:
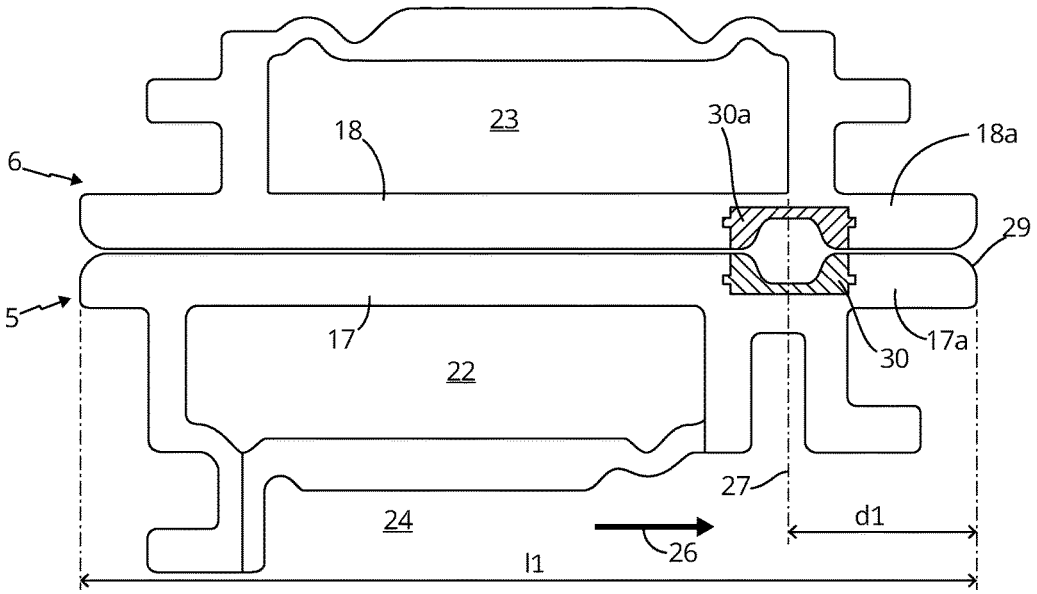
FIGS. 9, 10, 11 and 12 illustrate other alternative embodiments of the containment means.

Thus, FIG. 9 illustrates an embodiment of the space with one or two respective parts made of glass inserted into a converted space that is larger than the space of the final channel of the heating plates. The channel or channels are formed in the one or two glass parts. The part or parts of glass can be illuminated by one or several light-emitting diodes (LED) to form lighted bars on each side of the containment channel.

Figure 10:
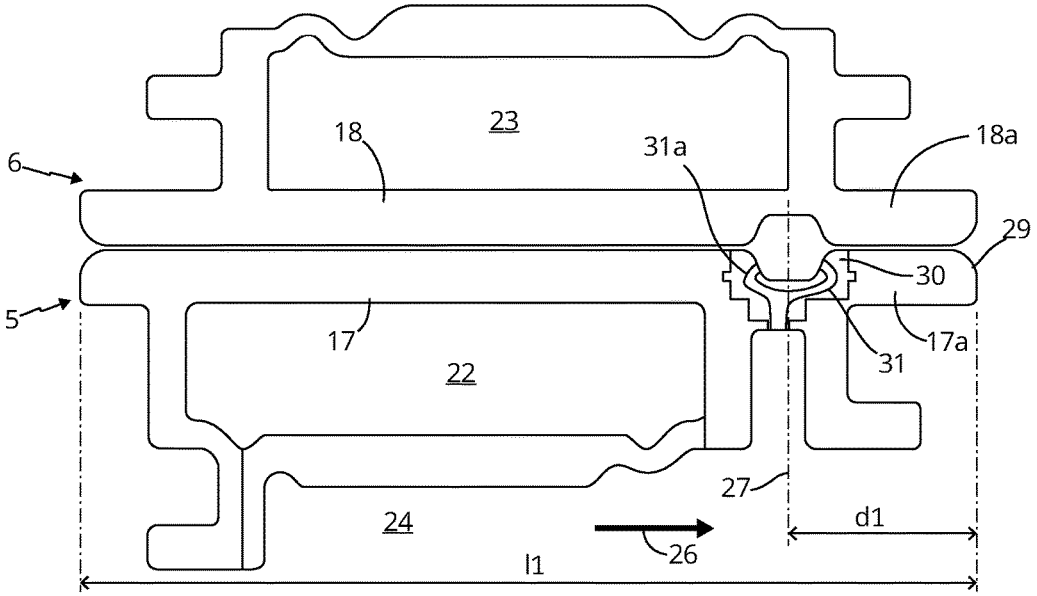

FIG. 10 illustrates an alternative embodiment in which the steam is transported by two input channels 31, 31*a* for the steam originating from the vaporization chamber. To do this, the particular part is inserted into the largest converted space on the treatment surface of the plates. This part makes it possible to divert the steam arriving through the channel that originates in the vaporization chamber.

Figure 11:
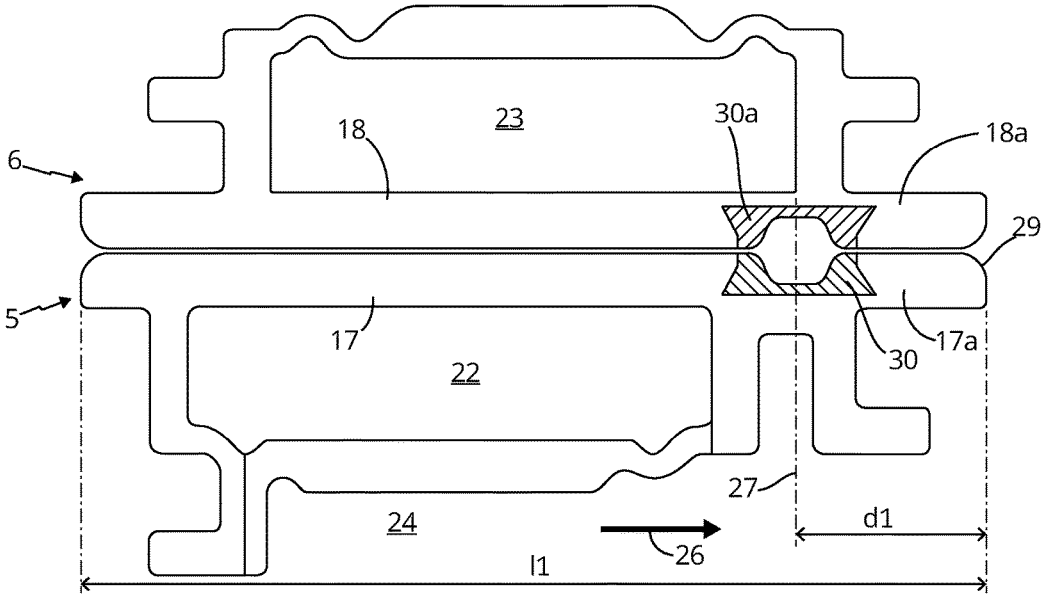

FIG. 11 illustrates an alternative embodiment in which the particular part or parts are made of aluminum and, for example, painted, and, for example, slid into the converted space. Fastening can be done by dovetailing. Modifying the size of the channel or channels by replacing the particular part or parts is conceivable.

Figure 12:
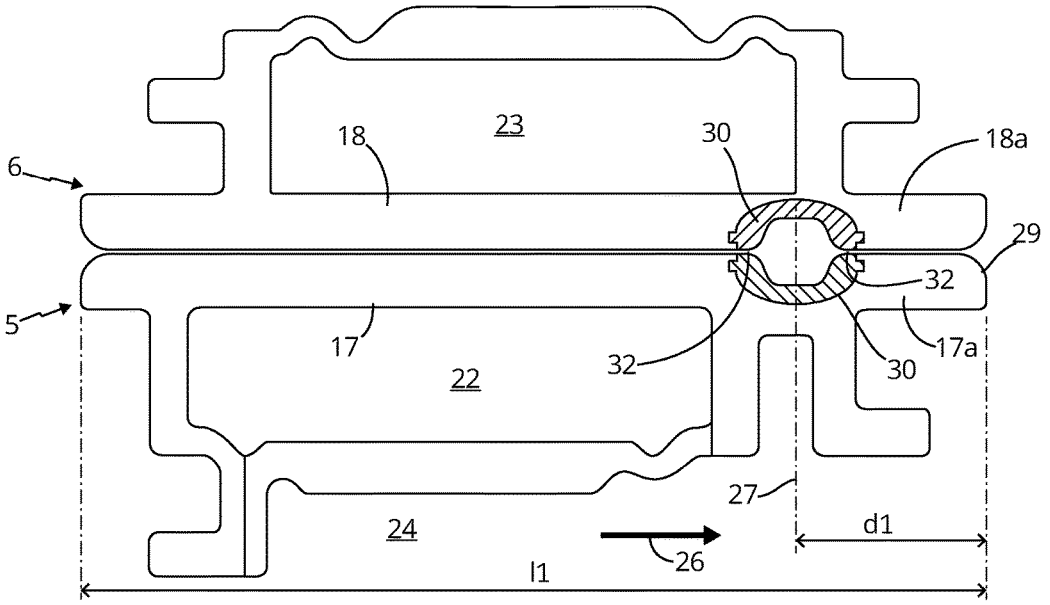

Finally, FIG. 12 illustrates an alternative embodiment in which the particular part or parts are made of silicone 30, 30*a*. Advantageously and as illustrated, the silicone part 30, 30*a*, once it is in place, may protrude from the surface of the heating plate 17, thus creating an area of tension 32 or an area of traction 32 of the hair on the side of the channel, enabling a better and gentler straightening of the lock of hair.

In FIG. 1, a comb 19 is arranged upstream from the first surface 5 on the first arm 3. This comb 19 enables the untangling and aeration of the lock of hair prior to its passage between the two surfaces 5, 6.

Other variations of implementation are conceivable within the scope of the invention.

A containment space that is constituted solely by the volume of a channel 9 on the second surface 6, or solely by the volume of a groove 10 comprising steam dispersion or spraying openings 12 on the first surface 5, inter alia, is conceivable. In this case, said volume of the channel 9 or the groove 10, should be dimensioned so as to constitute said steam containment space.

The arrangement of the containment means and steam dispersion or spraying means 7 on the surfaces 5, 6, separately from the heating plates 17, 18, is likewise conceivable, with said containment means and said steam dispersion and spraying means 7 being positioned upstream from said heating plates 17, 18.

According to the aforementioned different alternative embodiments, the steam dispersion or spraying openings 12 can also be replaced by a steam dispersion or spraying vent arranged in the bottom 11, 11' of the groove 10, 10', while maintaining a flow of steam ranging between 0.5 g/min and 2 g/min, preferably between 0.9 g/min and 1.2 g/min.

According to the aforementioned different alternative embodiments, an embedded ionizer intended to supply ions in the steam containment means to eliminate static electricity can be added.

The invention claimed is:

1. Hairdressing appliance comprising: a portable treatment unit equipped with first and second arms pivotably joined at proximal portions thereof to form a clamp, the first arm having a first surface and the second arm having a second surface, where the first and second surfaces are positioned opposite each other and enable the simultaneous clamping of a lock of hair there between, a steam dispersion means configured to disperse steam from the first surface towards the second surface, and a containment means for containing the dispersed steam, wherein the first surface comprises two adjacent grooves separated by a thin partition wall, each groove having a bottom, where at least one of the bottoms comprises a dispersion vent or a plurality of dispersion openings forming the dispersion means, and the steam containment means comprises a channel arranged in the second surface directly opposite the grooves, the channel has a width extending along a lateral direction, a length extending along a longitudinal direction transverse to the lateral direction and a depth which penetrates the second surface in a direction away from the first surface and transverse to both the width and the length, the width ranging between 2 and 6 mm, and a depth ranging between 0.5 and 2 mm, wherein the width of the channel corresponds to a total width of the grooves, wherein the grooves and the channel are offset in an upstream portion of the first and second surfaces, respectively, to form a single containment space offset in only the upstream portions of the first and second surfaces, wherein the upstream portions of the first and second surfaces are positioned laterally offset from a center of the first and second surfaces such that the channel and grooves extend along the longitudinal direction and do not cross a center of the first and second surfaces, a heating means provided in at least one of said first and second arms and operatively coupled to the first and/or second surfaces, respectively, and a vapor barrier projecting away from the first arm toward the second arm and disposed adjacent to a proximal lateral edge of the first surface, wherein the vapor barrier is configured to block the steam escaping from the containment means in the direction of the proximal portion of the clamp, which is configured to manipulate the portable treatment unit.

2. Hairdressing appliance as in claim 1, wherein the second surface includes a distal lateral edge opposite the proximal lateral edge and the channel empties on at least one of the proximal and distal lateral edges of the second surface.

3. Hairdressing appliance as in claim 1, wherein the length of the channel ranges between 20 and 220 mm.

4. Hairdressing appliance as in claim 1, wherein the channel and the grooves have a volume that is substantially identical.

5. Hairdressing appliance as in claim 1, wherein at least one groove empties on at least one of two lateral edges of the first surface.

6. Hairdressing appliance as in claim 1, wherein the each of the bottoms of the grooves comprise a plurality of dispersion openings arranged over a length of each of the grooves.

7. Hairdressing appliance as in claim 1, wherein the steam dispersion means comprises a dispersion vent arranged over a length of the bottom of each of the grooves.

8. Hairdressing appliance as in claim 1, wherein a grid is arranged above at least one of the grooves on the first surface.

9. Hairdressing appliance as in claim 1, wherein the first and second surfaces are each formed on a heating plate, said heating plates being positioned opposite one another and simultaneously enabling the clamping of a lock of hair.

10. Hairdressing appliance as in claim 9, wherein the steam containment means are arranged between the two heating plates.

11. Hairdressing appliance as in claim 10, wherein a midpoint of the containment means is located at a distance (d1) from an upstream edge of the heating plates, with the ratio of the distance (d1) to a width (w1) of the heating plates ranging between 0.1 and 0.4.

12. Hairdressing appliance as in claim 1, wherein a comb is arranged upstream from one of the first and second surfaces.

13. Hairdressing appliance as in claim 1, wherein the steam dispersion means is configured to have a flow of steam ranging between 0.5 g/min and 2 g/min.

* * * * *